US006109238A

United States Patent [19]

Sakai

[11] Patent Number: 6,109,238

[45] Date of Patent: Aug. 29, 2000

[54] IDLING-ENGINE-SPEED CONTROL METHOD AND CONTROLLER THEREFOR

[75] Inventor: Yutaka Sakai, Tokyo, Japan

[73] Assignee: Mitsubishi Denki Kabushiki Kaisha, Tokyo, Japan

[21] Appl. No.: 09/190,457

[22] Filed: Nov. 13, 1998

[30] Foreign Application Priority Data

Jun. 3, 1998 [JP] Japan ..... 10-154983

[51] Int. Cl.[7] ..... F02D 41/06; F02D 41/16

[52] U.S. Cl. ..... 123/339.22; 123/339.24

[58] Field of Search ..... 123/339.24, 339.1, 123/339.22

[56] References Cited

FOREIGN PATENT DOCUMENTS

| | | | |
|---|---|---|---|
| 8440 | 1/1985 | Japan | 123/339.24 |
| 61-53544 | 11/1985 | Japan . | |
| 261951 | 12/1985 | Japan | 123/339.24 |
| 50446 | 2/1992 | Japan | 123/339.1 |
| 146959 | 5/1994 | Japan | 123/339.24 |

*Primary Examiner*—Andrew M. Dolinar
*Assistant Examiner*—Hyder Ali
*Attorney, Agent, or Firm*—Sughrue, Mion, Zinn, Macpeak & Seas, PLLC

[57] ABSTRACT

An idling-engine-speed control method and apparatus capable of stabilizing an engine speed before completion of warming-up even if cooling water temperatures greatly change compared to the voltage change of water temperature sensor outputs under the transition state in which the cooling-water temperature of an engine changes from a low temperature to a high temperature. A simulated water temperature setting device for generating a simulated cooling water temperature WTm operating so as to keep a holding start water temperature $WT_{ks}$ when a cooling water temperature WT exceeds the holding start water temperature $WT_{ks}$ and converge to the cooling water temperature WT in accordance with a predetermined change rate when the cooling water temperature WT exceeds a warming-up completed water temperature $WT_{ke}$ is used to determine the target engine speed under idling in accordance with the simulated cooling water temperature.

7 Claims, 6 Drawing Sheets

IDLING-ENGINE-SPEED CONTROL METHOD AND CONTROLLER THEREFOR

BACKGROUND OF THE INVENTION

1. Field of the Invention

The present invention relates to an idling-engine-speed control method and an idling-engine-speed controller.

2. Description of the Prior Art

As disclosed in, for example, the Japanese Patent Publication No. 53544/1986, a conventional engine-speed controller stabilizes an idling engine speed under the transition state from cold state to hot state of an engine by controlling an intake air quantity in accordance with the deviation between a target engine speed set correspondingly to the cooling-water temperature of the engine and the actual speed of the engine. In this case, a cooling-water-temperature signal output from a water-temperature sensor for measuring the cooling-water temperature of the engine is A/D-converted by the input port of a microcomputer and transferred to a CPU for computing the controlled variable of idling engine speed. That is, the digital value obtained by A/D-converting a voltage input from the above water-temperature sensor is used as a cooling-water temperature to be referenced to select the above target engine speed.

An actual water-temperature change gets larger than the change of the A/D-converted value in a high temperature region because of the characteristic of a water-temperature sensor. Therefore, the A/D-converted value of a cooling-water temperature (cooling-water temperature to be referenced to select a target idling engine speed) may sensitively react even for the change of outputs of an water-temperature sensor in minimum resolutions around a warming-up completed water temperature. Therefore, in the case of a conventional idling-engine-speed control method, a cooling-water temperature greatly fluctuates even if a slight change occurs in outputs of a water-temperature sensor immediately before completion of warming-up and as a result, a problem occurs that a target engine speed and a bypass air quantity to be determined by the cooling-water temperature also fluctuate and thereby, the engine speed immediately before completion of warming-up is not stabilized. Moreover, because the rise rate of an actual cooling-water temperature is loosened as the actual cooling-water temperature approaches the cooling-water temperature at completion of warming-up, a delicate state that cooling-water temperature values are changed or not changed by 1 bit easily continues and thereby, slight fluctuation in outputs of the water-temperature sensor easily occurs for a long time. Furthermore, in the region from the time immediately before completion of warming-up to the time of completion of warming-up, the gradient of a target ending speed and a bypass air quantity to be set correspondingly to a cooling-water temperature to the cooling-water temperature relatively increases. Therefore, when the above cooling-water temperature value fluctuates, set values of the above target engine speed and bypass air quantity greatly fluctuate and hunting may occur because the engine speed immediately before completion of warming-up.

SUMMARY OF THE INVENTION

The present invention is made to solve the above problems and its object is to provide an idling-engine-speed control method and controller therefor capable of stabilizing the engine speed before completion of warming-up even if cooling-water temperature values greatly change compared to the voltage change of water-temperature-sensor outputs under the transition state in which the cooling-water temperature of an engine under warming-up changes from a low temperature to a high temperature.

The idling-engine-speed control method of the present invention is characterized by setting a simulated cooling-water temperature not so as to follow a slight change of outputs of a water-temperature sensor of an engine and controlling the engine speed under idling in accordance with the simulated cooling-water temperature.

The idling-engine-speed control method of the present invention is characterized by setting a simulated cooling-water temperature so as to keep a preset first set water temperature when a cooling-water temperature exceeds the preset first set water temperature and converge to the cooling-water temperature in accordance with a predetermined change rate when the cooling-water temperature exceeds a second set water temperature higher than the first set water temperature.

The idling-engine-speed controller of the present invention is characterized by using simulated water-temperature setting means for generating a simulated cooling-water temperature operating so as to keep a first set water temperature when a cooling-water temperature exceeds the first set water temperature and converge to the cooling-water temperature in accordance with a predetermined change rate when the cooling-water temperature exceeds a second set water temperature higher than the first set water temperature under the transition state in which the cooling-water temperature changes from a low temperature to a high temperature and determining a target value of the idling speed of an engine in accordance with the simulated cooling-water temperature.

The idling-engine-speed controller of the present invention is characterized by setting the above target engine speed correspondingly to an engine operating state.

The idling-engine-speed controller of the present invention is characterized by computing a basic bypass air quantity serving as the base for computing the bypass air quantity flowing through a bypass route in accordance with the above simulated cooling-water temperature.

The idling-engine-speed controller of the present invention is characterized by setting a basic bypass air quantity correspondingly to an engine operating state.

The idling-engine-speed controller of the present invention is characterized by computing a correction value of a basic bypass air quantity in accordance with the above simulated cooling-water temperature.

DETAILED DESCRIPTION OF THE PREFERRED EMBODIMENT

Embodiments of the present invention are described below by referring to the accompanying figures.

Embodiment 1

Figure 1:
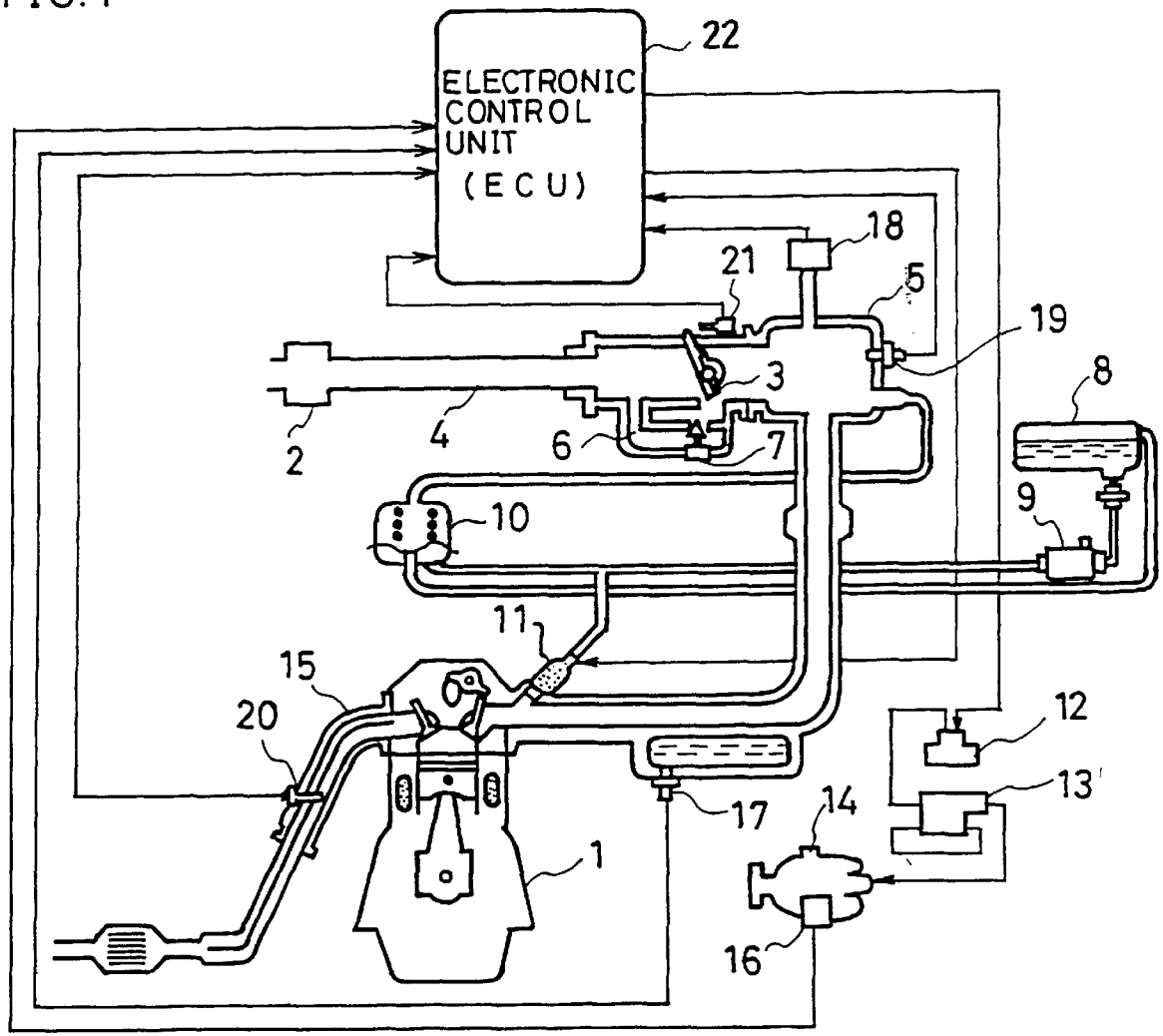
FIG. 1 is an illustration showing a structure of the engine fuel injection quantity controller of an embodiment of the present invention.

FIG. 1 is an illustration showing a structure of the engine fuel injection quantity controller of embodiment 1 of the present invention. In FIG. 1, reference numeral 1 denotes an engine mounted on, for example, a vehicle, in which the fuel air to be supplied to an engine 1 passes through an intake pipe 4 provided with a throttle valve 3 for adjusting an intake air quantity from an air cleaner 2 and is taken in through a surge tank 5. However, because the throttle valve 3 is closed under idling, air is supplied to the engine 1 through a bypass route 6 provided for the intake pipe 4. The opening degree of the bypass route 6 is adjusted by a solenoid valve 7 and a combustion air quantity corresponding to the opening degree is supplied to the engine 1. However, fuel is sent by a fuel pump 9 from a fuel tank 8 and adjusted to a predetermined injection fuel pressure by a fuel pressure regulator 10 and thereafter, supplied to each cylinder of the engine 1 by means of injection through an injector 11 provided for each cylinder. An ignition signal for ignition is successively supplied to not-illustrated ignition plug provided for each cylinder of the engine 1 through an ignition driving circuit 12, an ignition coil 13, and a distributor 14 in order. Exhaust gas after combustion is exhausted to the atmosphere through an exhaust manifold 15 and the like.

Moreover, reference numeral 16 denotes a crank angle sensor for detecting the rotational speed of the crank shaft of the engine 1, which outputs a crank angle signal comprising a frequency pulse signal corresponding to a rotational speed such as a pulse signal rising at BTDC 75° and falling at BTDC 5°. Reference numeral 17 denotes a water-temperature sensor for detecting the cooling-water temperature of the engine 1 and 18 denotes a pressure sensor which is set to the surge tank 5 to detect the pressure in an intake pipe as an absolute pressure and output a pressure detection signal having a magnitude corresponding to the intake-pipe pressure. Reference numeral 19 denotes an intake air temperature sensor which is set to the surge tank 5 to detect the temperature of intake air, 20 denotes an air-fuel ratio sensor which is set to the exhaust manifold 15 to detect the oxygen concentration of exhaust gas, and 21 denotes an idling switch for detecting that the throttle valve 3 is closed under idling. Each of detection signals of the sensors 16 to 20 and the idling switch 21 are supplied to an electronic control unit (hereafter referred to as ECU) 22. The ECU 22 determines a fuel injection quantity corresponding to an operating state in accordance with (each of the above detection signals and controls the valve opening time of the injector 11 and thereby, adjusts a fuel injection quantity and controls the ignition driving circuit 12.

Figure 2:
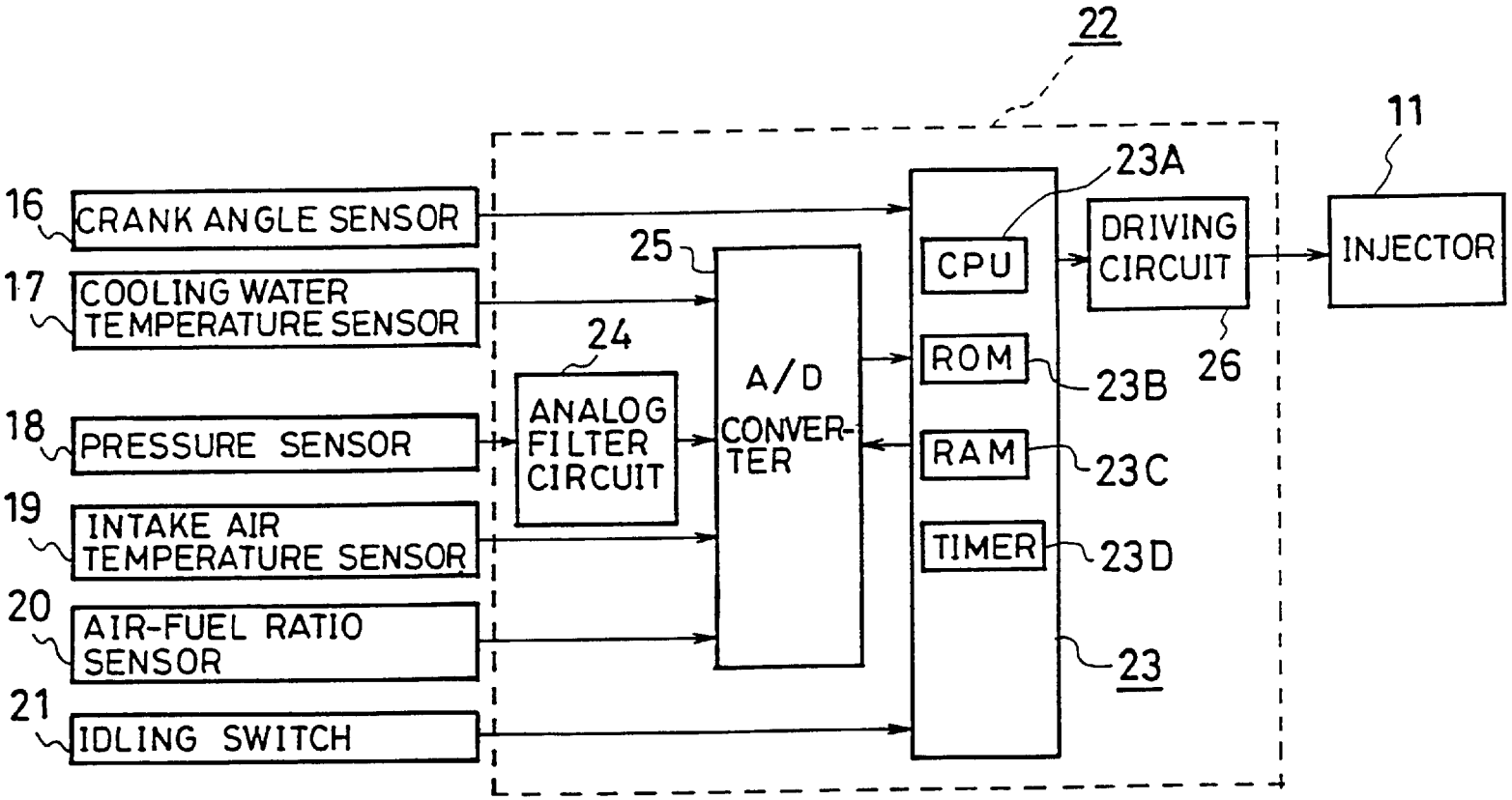
FIG. 2 is an illustration showing a structure of an ECU of an embodiment of the present invention.

FIG. 2 is an illustration showing the detailed structure of the ECU 22. The ECU 22 is provided with a microcomputer 23 for deciding various operations, an analog filter circuit 24 for reducing ripples of a pressure detection signal sent from the pressure sensor 18, an A/D converter 25 for successively converting analog detection signals of the intake air temperature sensor 19, water temperature sensor 17, and air-fuel ratio sensor 20 and an output signal of the analog filter circuit 24 into digital values, and a driving circuit 26 for driving the injector 11. Moreover, FIG. 2 shows only an output section corresponding to a fuel control section as the output section of the ECU 22.

A not-illustrated input port of the microcomputer 23 is connected to the crank angle sensor 16, idling switch 21, and the output terminal of the A/D converter 25 and a not-illustrated output port of the microcomputer 23 is connected to the A/D converter 25 in order to transmit a reference signal and moreover connected to the input terminal of the driving circuit 26. Moreover, the microcomputer 23 is provided with a CPU 23A for deciding various operations, a ROM 23B storing flows for setting a simulated water temperature to be described later and controlling an idling engine speed as programs, a RAM 23C serving as a work memory, and a timer 23D for presetting the valve opening time of the injector 11 and has functions serving as simulated water-temperature setting means for generating a simulated cooling-water temperature and idling-engine-speed control means.

Then, a simulated-water-temperature setting method and an idling-engine-speed control method to be executed by the microcomputer 23 in the ECU 22 are described below.

Figure 3:
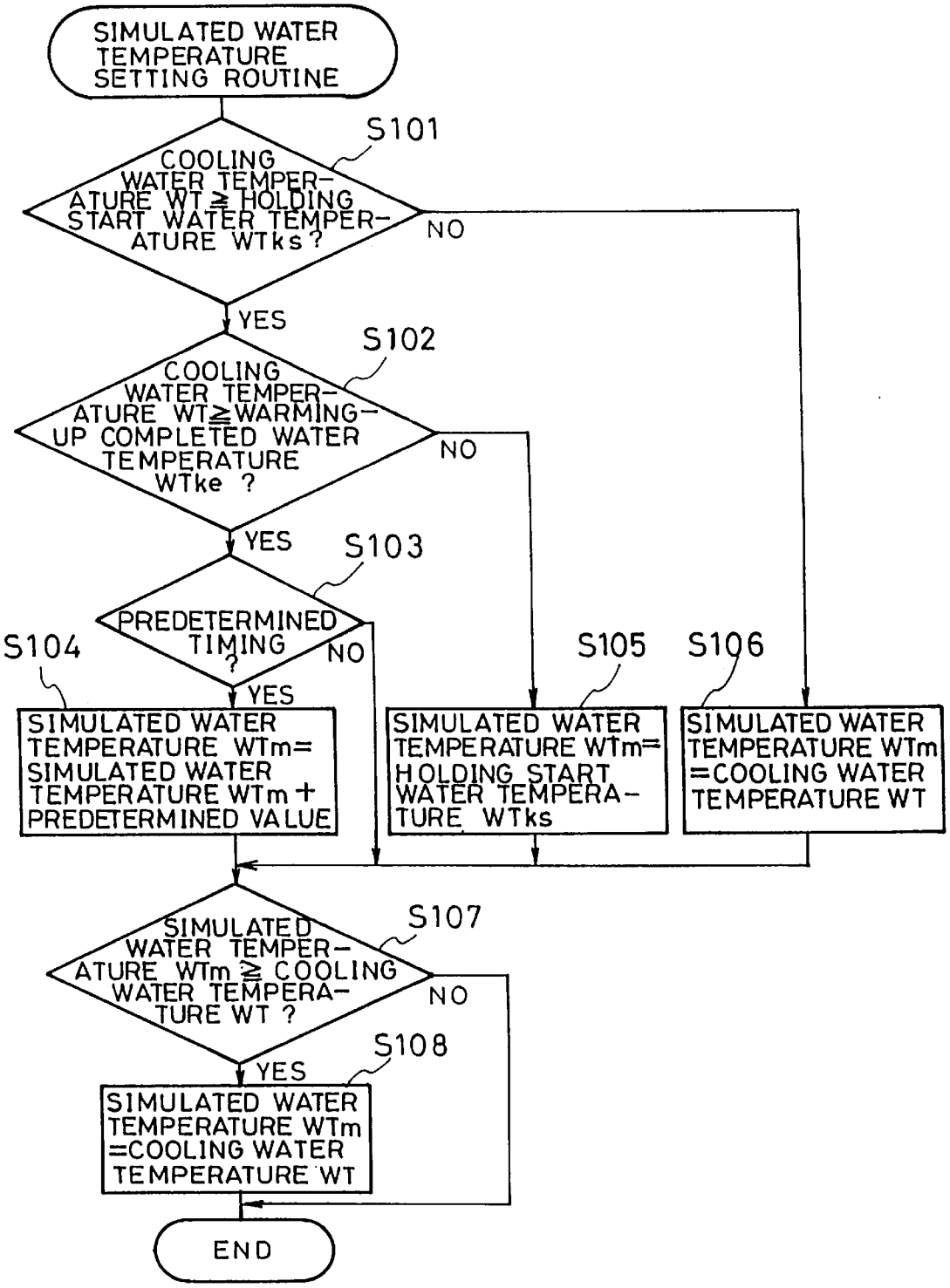
FIG. 3 is a flow chart showing a simulated-water-temperature setting method.

First, a simulated-water-temperature routine is described by referring to the flow chart in FIG. 3. In step S101, a detection signal of the water temperature sensor 17 is A/D-converted by the A/D converter 25 in accordance with a not-illustrated routine and thereafter, the cooling-water temperature WT stored in the RAM 23C is compared with the holding start water temperature $WT_{ks}$ serving as a first set water temperature for starting holding the simulated water temperature WTm. When the cooling water temperature WT is equal to or higher than the holding start water temperature $WT_{ks}$, step 102 is started. However, when the cooling water temperature WT is lower than the holding start water temperature $WT_{ks}$, step S106 is started. In step 102, the cooling water temperature WT is compared with the warming-up completed water temperature $WT_{ke}$ serving as a second set water temperature. When the cooling water temperature WT is equal to or higher than the warming-up completed water temperature $WT_{ks}$, it is decided that warming-up is completed, step S103 is started, and for example, a predetermined value is added to the simulated water temperature WTm every predetermined timing (step S104), and step S107 is started. However, when the cooling water temperature WT is lower than the warming-up completed water temperature $WT_{ks}$, it is decided that warming-up is not completed, step S107 is started, the simulated water temperature WTm is held at the holding start water temperature $WT_{ks}$, and step S107 is started. However, when it is decided in step S101 that the cooling water temperature WT does not reach the holding start water temperature $WT_{ks}$, the cooling water temperature WT is directly set as the simulated water temperature WTm in step S106 and step S107 is started. In step S107, when the set simulated water temperature WTm is equal to or higher than the cooling water temperature WT, it is decided that convergence of the simulated water temperature WTm to the cooling water temperature is completed, the cooling water temperature WT is directly set to the simulated water temperature WTm, and the simulated water temperature setting routine is completed.

Figure 4:
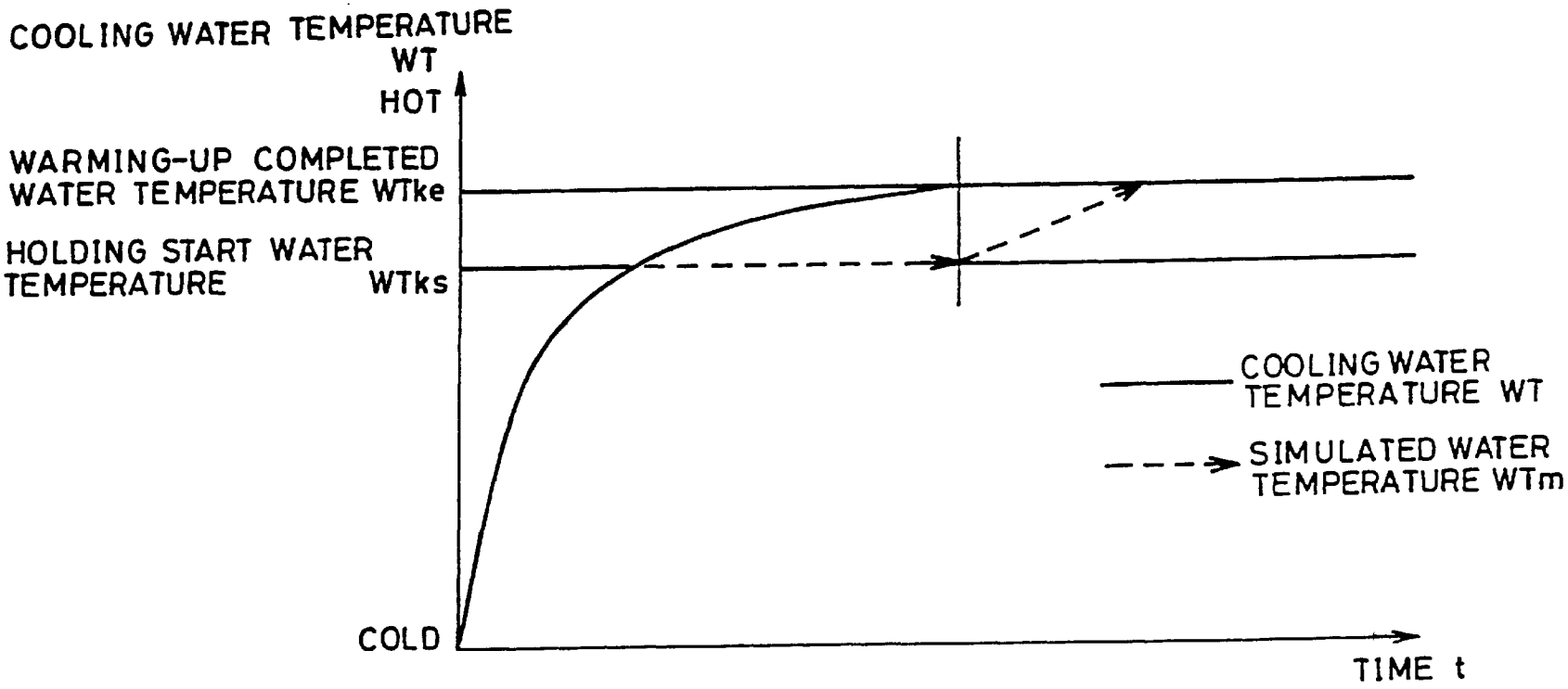
FIG. 4 is an illustration showing the relation between cooling water temperature and simulated water temperature.

FIG. 4 shows the relation between the cooling water temperature WT and the simulated water temperature WTm in the simulated water temperature setting routine. Under the transition state in which the engine cooling-water temperature under warming-up changes from a low temperature to a high temperature, the simulated water temperature WTm holds a constant value equal to the holding start water temperature $WT_{ks}$ before the cooling, water temperature WT reaches the warming-up completed water temperature $WT_{ke}$ after it exceeds the holding start water temperature $WT_{ks}$, rises in accordance with a predetermined change rate after the cooling water temperature WT exceeds the warming-up completed water temperature $WT_{ke}$, and converges to the cooling water temperature WT.

Then, an idling-engine-speed control routine is described below by referring to the flow chart in FIG. 5. In step S201, an actual speed Ne of the engine 1 is computed in accordance with the pulse cycle of the crank angle sensor 16 computed in accordance with, for example, a not-illustrated interrupt routine. Then, step S202 is started. In step S202, a target engine speed Nt is computed correspondingly to an engine operating state such as the simulated water temperature WTm set in the simulated water temperature setting routine (FIG. 3) or the gear state obtained from a torque converter signal sent from a not-illustrated torque converter switch and then, step S203 is started. A basic air quantity $Q_{base}$ is computed in step S203 correspondingly to an engine operating state such as the simulated water temperature WTm and then, step S204 is started. In step S204, it is decided whether an idling state is set in accordance with the input state of the idling switch 21 or a not-illustrated speed sensor. Unless the idling state is set, step S207 is started. When the idling state is set, it is decided in step S205 whether a predetermined timing (timing for feedback correction of engine speed) is set. Unless the predetermined timing is set, step S207 is started. However, when the predetermined timing is set, an engine-speed feedback correction value $Q_{n/b}$ corresponding to the actual engine speed Ne and target engine speed Nt is computed in step 206 and then, step S207 is started. In step S207, various correction air quantities $Q_{etc}$ corresponding to changes of operating states of an engine due to change of loaded states due to, for example, turning-on of an air conditioner are computed and then, step S208 is started. In step S208, a controlled air quantity $Q_{isc}$ is computed by adding the basic air quantity $Q_{base}$ obtained in step S203, the engine-speed feedback correction value $Q_{n/b}$ obtained in step S206, and the correction air quantities $Q_{etc}$ obtained in step S207 and then, step S209 is started. In step S209, an air control valve driving value (e.g. the driving duty D of the solenoid valve 7) is computed in accordance with the controlled air quantity $Q_{isc}$ computed in step S208 to complete the idling-engine-speed control routine.

Figure 5:
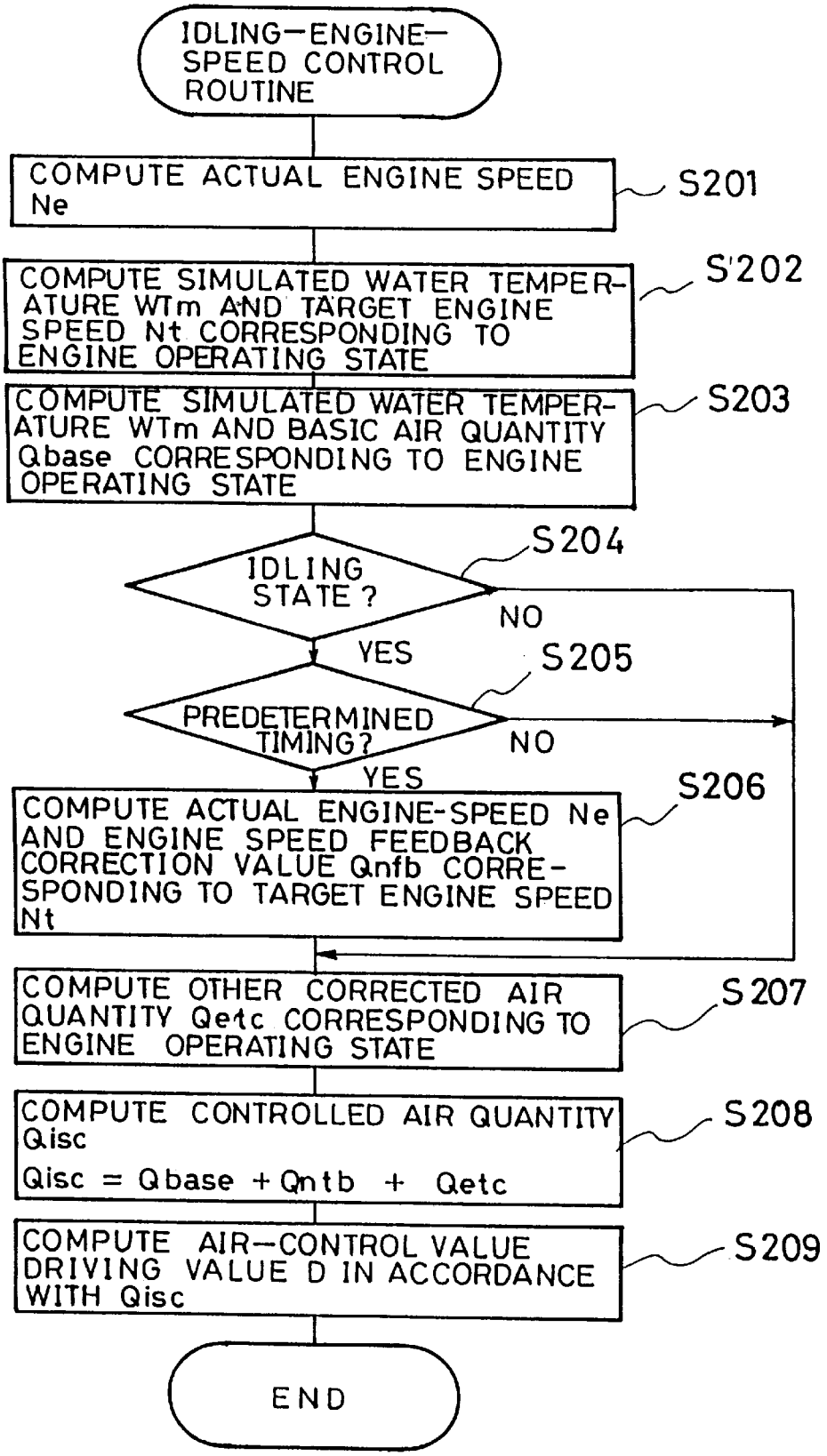
FIG. 5 is a flow chart showing an idling-engine-speed control method.
Figure 6:
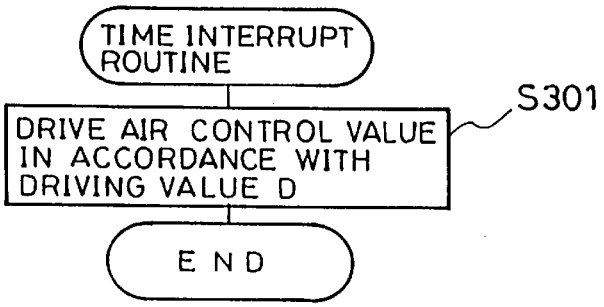
FIG. 6 is a flow chart showing an idling-engine-speed control method.

Moreover, the timer interrupt routine in FIG. 6 is started whenever a certain time passes to drive the solenoid valve 7 in accordance with the air control valve driving value D computed in FIG. 5 and the timer interrupt routine is completed.

Figure 7:
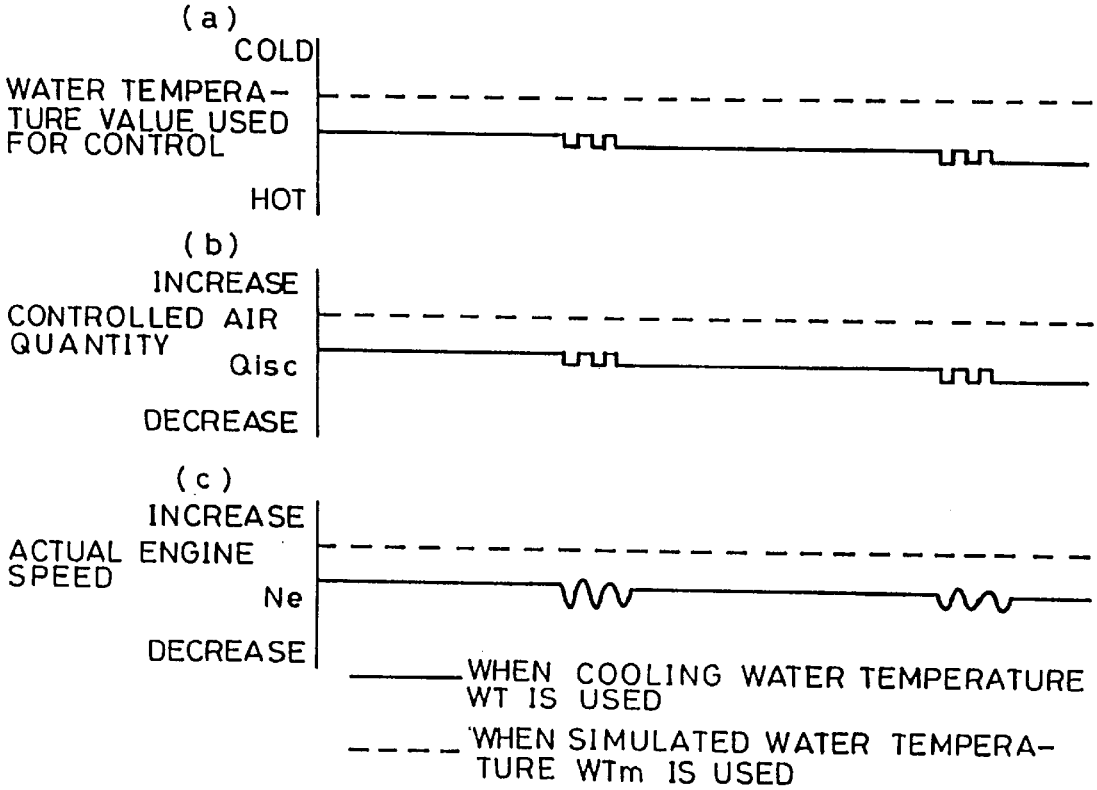
FIGS. 7(*a*) to 7(*c*) are illustrations showing changes of cooling water temperatures used for intake air quantity control, controlled air quantities, and actual engine speeds.

FIGS. 7(*a*), 7(*b*), and 7(*c*) are illustrations showing the comparison between changes of the controlled air quantity $Q_{isc}$ and actual engine speed Ne when using a conventional idling-engine-speed control method (shown by continuous lines in FIG. 7) and when using an idling-engine-speed control method of the present invention (shown by broken lines in FIG. 7), in a region immediately before completion of warming-up. In the case of the conventional method, the cooling water temperature WT greatly fluctuates even if water temperature sensor outputs are slightly changed as shown in FIG. 7(*a*) because the cooling water temperature WT is a digital value. Because the above fluctuation is reflected on the controlled air quantity $Q_{isc}$ computed by using the cooling water temperature WT as shown in FIG. 7(*b*), the actual engine speed Ne fluctuates as shown in FIG. 7(*c*). In the case of the control method of the present invention using the simulated water temperature WTm for computation of the controlled air quantity $Q_{isc}$, because the simulated water temperature WTm has a constant value, the controlled air quantity $Q_{isc}$ does not change and therefore, it is possible to control the fluctuation of the actual engine speed Ne as shown in FIG. 7(*c*).

In the case of the above embodiment, the simulated water temperature WTm does not follow a slight change of water temperature sensor outputs by setting the simulated water temperature WTm so as to keep a constant value equal to-the holding start water temperature $WT_{ks}$ until the cooling water temperature WT reaches the warming-up completed water temperature $WT_{ke}$ after exceeding the holding start water temperature $WT_{ks}$. However, it is also possible to set the raised cooling water temperature TW to a new simulated water temperature WTm only when the cooling water temperature WT obtained by A/D-converting an water temperature sensor output continuously rises preset times after the cooling water temperature WT exceeds the holding start water temperature $WT_{ks}$ so as to hold the simulated water temperature. In this case, the simulated water temperature WTm becomes a stepwise state in which a temperature holding portion is slowly lengthened until the cooling-water temperature WT reaches the warming-up completed water temperature $WT_{ke}$ after exceeding the holding start water temperature $WT_{ks}$.

As described above, according to the invention, it is possible to stably control an idling engine speed even if a slight fluctuation occurs in water temperature sensor outputs because of setting a simulated cooling water temperature not so as to follow a slight change of outputs of an engine water-temperature sensor and controlling the engine speed under idling in accordance with the simulated cooling water temperature.

According to the invention, it is possible to easily stably control an idling engine speed even if a slight fluctuation occurs in water temperature sensor outputs because of setting a simulated cooling water temperature so as to keep a preset first set water temperature when a cooling water temperature exceeds a preset first set water temperature and converge to the cooling water temperature in accordance with a predetermined change rate when the cooling water temperature exceeds a second set water temperature higher than the first set water temperature and moreover, it is possible to decrease the time up to completion of warming-up because air quantity is controlled in accordance with a temperature lower than the cooling water temperature until the cooling water temperature WT reaches the second set water temperature after exceeding the first set water temperature.

According to the invention, it is possible to provide an idling-engine-speed controller capable of stably controlling an idling engine speed even if cooling water temperatures greatly change compared to the voltage change of water temperature sensor outputs because of using simulated water temperature setting means for generating a simulated cooling water temperature operating so as to keep a first set water temperature when a cooling water temperature exceeds the first set water temperature and converge to the cooling water temperature in accordance with a predetermined change rate when the cooling water temperature exceeds a second set water temperature set higher than the first set water temperature under the transition state in which the cooling water temperature changes from a low temperature to a high temperature and determining the above target engine speed in accordance with the simulated cooling-water temperature.

According to the invention, it is possible to stabilize an idling engine speed independently of an engine operating state because of setting the above target engine speed correspondingly to the engine operating state.

According to the invention, it is possible to securely stabilize an idling engine speed because of computing a basic bypass air quantity serving as the base for computing a bypass air quantity flowing through a bypass route in accordance with the above simulated cooling water temperature.

According to the invention of claim 6, it is possible to securely stabilize an idling engine speed independently of an engine operating state because of setting a basic bypass air quantity correspondingly to the engine operating state.

According to the invention, it is possible to further stabilize an idling engine speed because of computing a correction value of a basic bypass air quantity in accordance with the above simulated cooling water temperature.

What is claimed is:

1. An idling-engine-speed control method, comprising the steps of:

a) setting under a transition state in which an engine cooling-water temperature changes from a low temperature to a high temperature, a simulated cooling-water temperature which does not follow a very small change of outputs of a water-temperature sensor for measuring said cooling-water temperature, and b) controlling the engine speed under idling in accordance with the simulated cooling water temperature setting.

2. The idling-engine-speed control method according to claim 1, wherein said simulated cooling-water temperature is set so as to keep a first set water temperature when a cooling-water temperature exceeds said preset first set water temperature and converge to said cooling-water temperature in accordance with a predetermined change rate when the cooling-water temperature exceeds a second set water temperature higher than said first set water temperature.

3. An idling-engine-speed controller provided with an intake-air-quantity control valve for controlling the air flow quantity of a bypass route provided for the air supply route to an engine so as to set a target engine speed in accordance with the cooling-water temperature of the engine and control said intake-air-quantity control valve in accordance with the deviation between said target engine speed and an actual engine speed, the controller comprising simulated water-temperature setting means for generating a simulated water temperature operating so as to keep a first set water temperature when said cooling-water temperature exceeds said first set water temperature and converge to said cooling-water temperature in accordance with a predetermined change rate when said cooling-water temperature exceeds a second set water temperature higher than said first set water temperature under the transition state in which said cooling-water temperature changes from a low temperature to a high temperature so as to determine said target engine speed in accordance with said simulated cooling-water temperature.

4. The idling-engine-speed controller according to claim 3, wherein said target engine speed is set correspondingly to an engine operating state.

5. The idling-engine-speed controller according to claim 3, wherein a basic bypass air quantity serving as the base for computing a bypass air quantity flowing through a bypass route is computed in accordance with said simulated cooling-water temperature.

6. The idling-engine-speed controller according to claim 3, wherein a basic bypass air quantity is set correspondingly to an engine operating state.

7. The idling-engine-speed controller according to claim 3, wherein a correction value of a basic bypass air quantity is computed in accordance with said simulated cooling-water temperature.

* * * * *